US010632586B1

(12) United States Patent
Wright et al.

(10) Patent No.: US 10,632,586 B1
(45) Date of Patent: Apr. 28, 2020

(54) TWO SPEED MULTI HEAD WOOD FLOOR SANDING SYSTEM

(71) Applicant: Amano Pioneer Eclipse Corporation, Sparta, NC (US)

(72) Inventors: Shawn Wright, Stilwell, OK (US); Derrick L. Hamm, Sparta, NC (US)

(73) Assignee: Amano Pioneer Eclipse Corporation, Sparta, NC (US)

( * ) Notice: Subject to any disclaimer, the term of this patent is extended or adjusted under 35 U.S.C. 154(b) by 174 days.

(21) Appl. No.: 15/877,644

(22) Filed: Jan. 23, 2018

(51) Int. Cl.

| | |
|---|---|
| ***B24B 47/12*** | (2006.01) |
| ***B24B 23/03*** | (2006.01) |
| ***B24B 7/18*** | (2006.01) |
| ***B24B 23/02*** | (2006.01) |

(52) U.S. Cl.
CPC ..... *B24B 7/186* (2013.01)

(58) Field of Classification Search
CPC ..... B24B 7/186; B24B 41/047; B24B 7/22
See application file for complete search history.

(56) References Cited

U.S. PATENT DOCUMENTS

| | | | | |
|---|---|---|---|---|
| 4,319,434 | A * | 3/1982 | Brejcha | B24B 41/047 15/49.1 |
| 5,548,860 | A * | 8/1996 | Weltikol | A47L 11/16 15/49.1 |
| 6,331,138 | B1 * | 12/2001 | Witters | B24B 41/047 451/340 |
| 7,022,004 | B2 * | 4/2006 | Bohler | B24B 7/186 451/350 |
| 9,604,341 | B2 * | 3/2017 | Truong | B24B 47/12 |
| 2013/0165025 | A1 * | 6/2013 | Kelly | B24B 7/18 451/177 |
| 2014/0323021 | A1 * | 10/2014 | Blick | B24B 41/002 451/540 |

* cited by examiner

*Primary Examiner* — Dung Van Nguyen
(74) *Attorney, Agent, or Firm* — Husch Blackwell LLP

(57) ABSTRACT

In an example embodiment, a floor sander comprises a motor having at least two selectable speeds, and a sanding adaptor driven to rotate about a rotational axis by the motor. The sanding adaptor includes a planetary disk that rotates about the rotational axis of the sanding adaptor. In addition, the sanding adaptor includes a plurality of sanding head units, each of which is coupled to the planetary disk for independent rotational movement. Each sanding head unit therefore rotates about its own rotational axis independently of any other sanding head unit or the planetary disk. An isolator is also provided, and is positioned generally between the planetary disk and the motor.

8 Claims, 4 Drawing Sheets

TWO SPEED MULTI HEAD WOOD FLOOR SANDING SYSTEM

FIELD OF INVENTION

The present invention relates generally to a sanding system. More particularly, the present invention relates to a floor sanding system with variable speeds and multiple orbital heads.

BACKGROUND OF INVENTION

Sanding wood floors has traditionally been accomplished with several types of machines. Some machines move an abrasive linearly across a flooring surface, generally parallel with the grain pattern of the wood floors to minimize the abrasive scratch detectable by the human eye. While such linear sanding tools are the most productive and fastest to use, they are not able to produce a flat furniture quality finish that is desired today on a finished wood floor.

Another technique that is often utilized involves the use of a circular or rotary motion, such as that which a traditional polisher would make. A sanding adaptor is used in place of the polishing pad or traditional brush. Unfortunately, this circular motion leaves a distinct scratch pattern on the floor that generally goes across the wood grain. Such scratches are generally longer, therefore visibly traveling across the wood grain. This scratch pattern is more visible to the eye after stain application. Further, circular sanders are slower than linear sanders, although they are faster than orbital sanders.

Orbital sanders are yet another option. Orbital sanders create a seemingly random set of scratches that break up the length of any particular scratch. This greatly reduces the visibility of the scratches after the floors are finished, and leads to the best visual appearance. However, orbital sanders are the slowest to use, leading to an increased cost of use.

Thus, there is a continuing need for improved sanders that have higher productivity, but still produce scratch patterns that are difficult for the human eye to detect after finishing

SUMMARY OF THE INVENTION

A sanding system is designed that takes advantage of the fine finish capability of an osculating or random orbital scratch pattern, yet provides increased productivity over circular or linear sanding tools. In an example embodiment, this is accomplished by a combination of a sanding driver and a two speed setting for machine RPM and sanding disks.

In an example embodiment, a floor sander comprises a motor having at least two selectable speeds, and a sanding adaptor driven to rotate about a rotational axis by the motor. The sanding adaptor includes a planetary disk that rotates about the rotational axis of the sanding adaptor. In addition, the sanding adaptor includes a plurality of sanding head units, each of which is coupled to the planetary disk for independent rotational movement. Each sanding head unit therefore rotates about its own rotational axis independently of any other sanding head unit or the planetary disk. An isolator is also provided, and is positioned generally between the planetary disk and the motor.

DESCRIPTION OF THE DRAWINGS

For a better understanding of the various embodiments of the present invention, reference may be made to the accompanying drawings in which.

Figure 1:
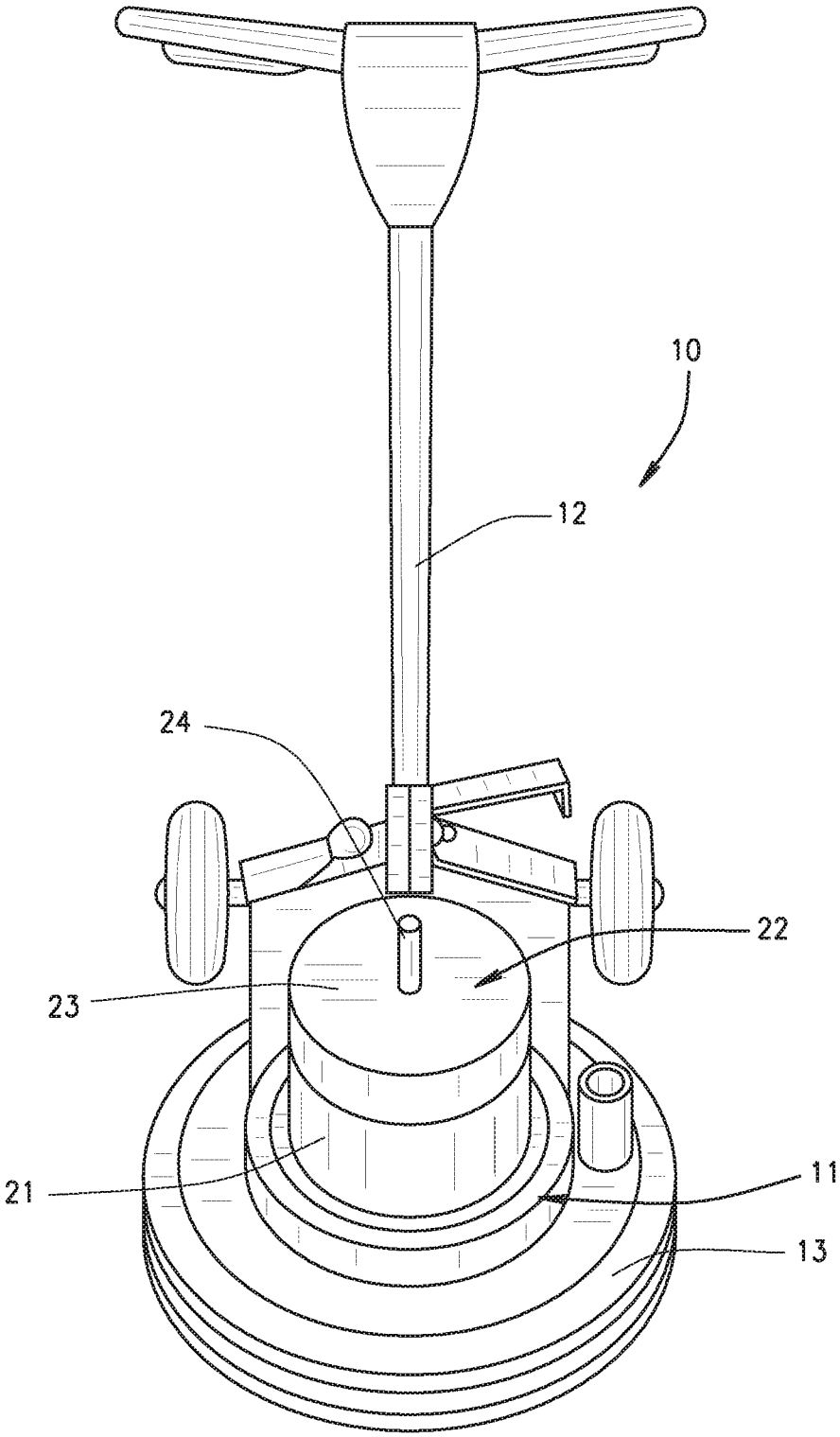
FIG. 1 a top perspective view of a floor sanding machine according to an example embodiment.

While the disclosure is susceptible to various modifications and alternative forms, a specific embodiment thereof is shown by way of example in the drawings and will herein be described in detail. It should be understood, however, that the drawings and detailed description presented herein are not intended to limit the disclosure to the particular embodiment disclosed, but to the contrary, the intention is to cover all modifications, equivalents, and alternatives falling within the spirit and scope of the present disclosure as defined by the appended claims.

DETAILED DESCRIPTION OF THE INVENTION

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

Figure 2:
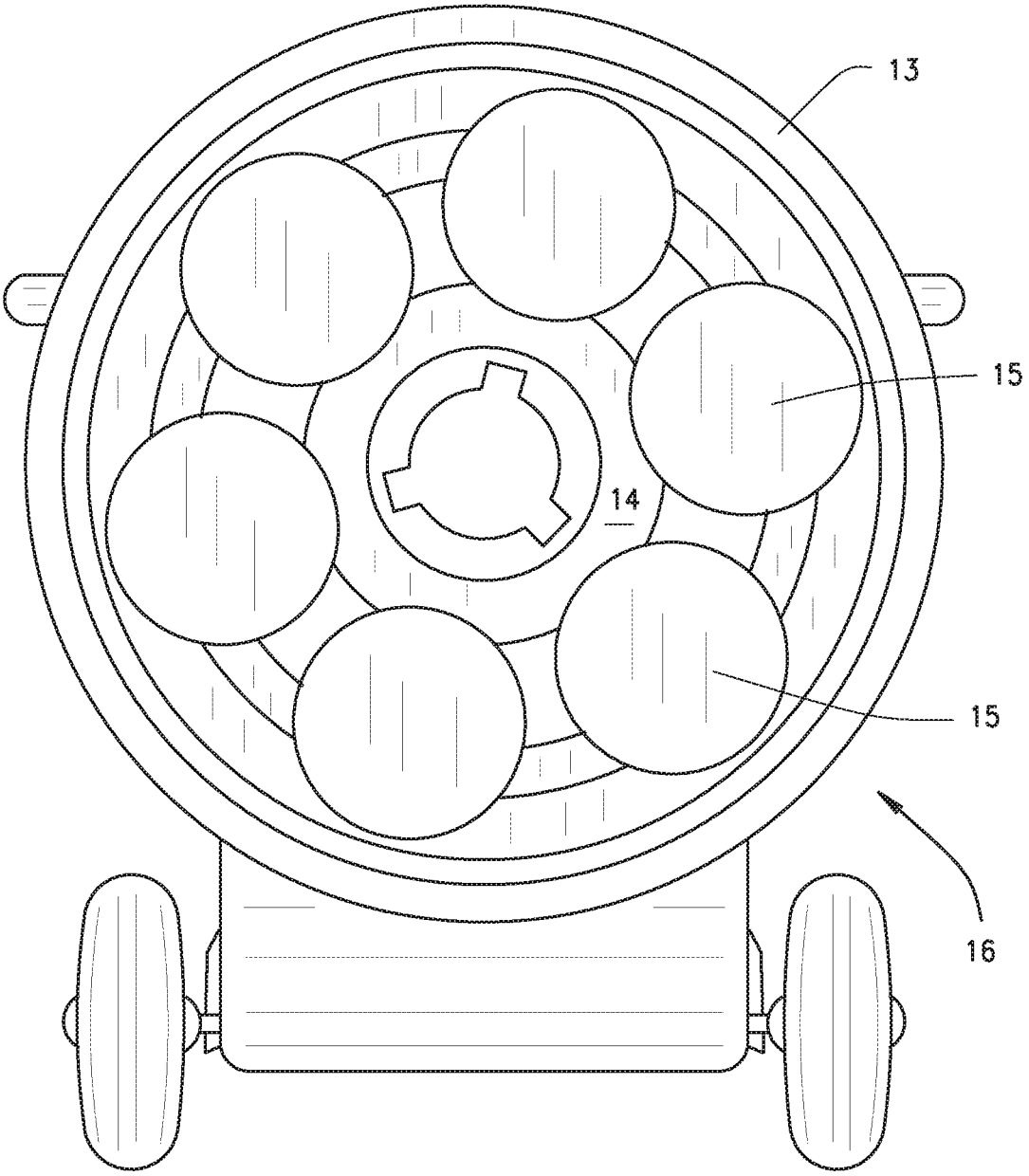
FIG. 2 is a bottom view of the floor sanding machine of FIG. 1.
Figure 3:
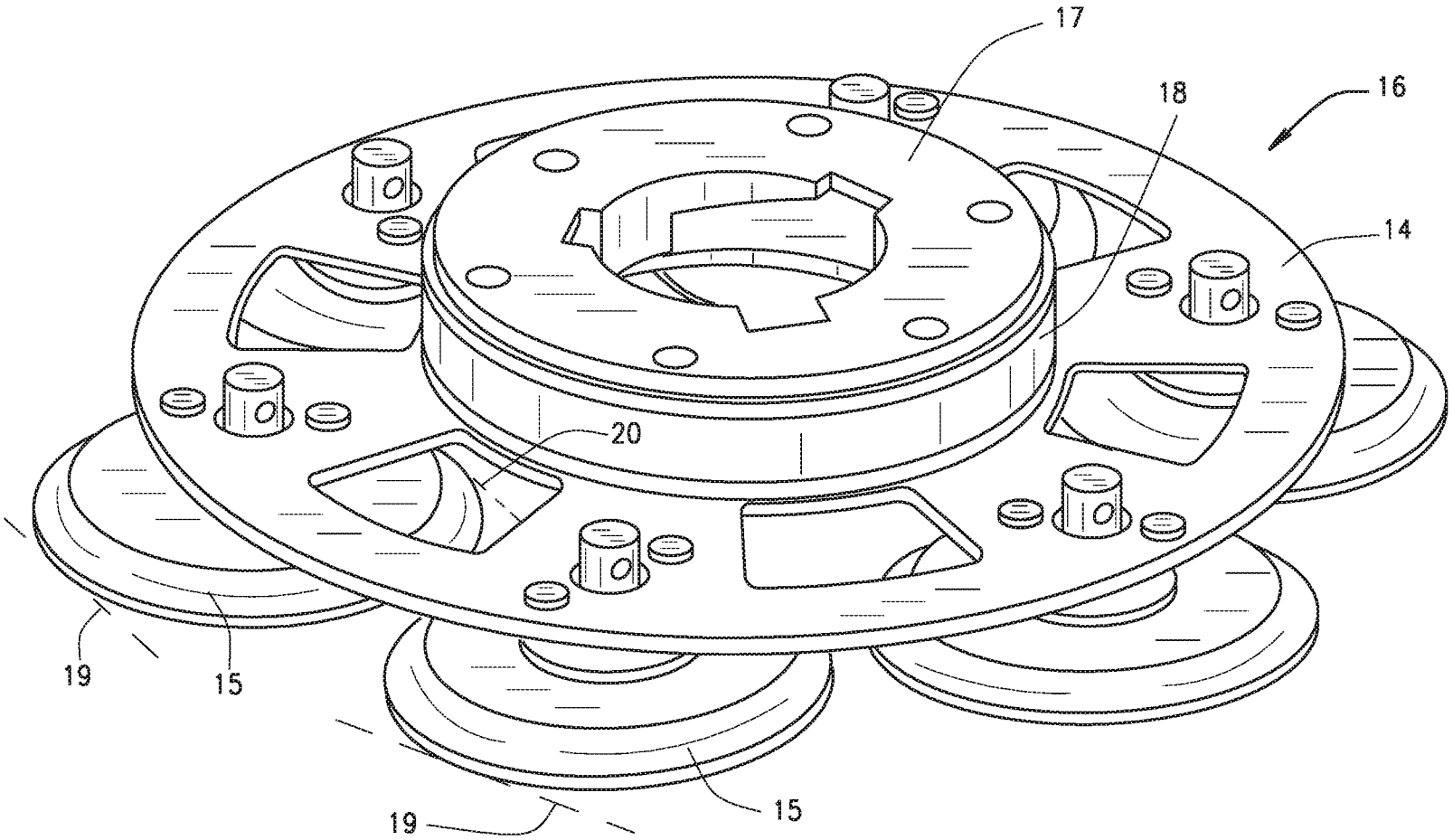
FIG. 3 is a view of a sanding adaptor as removed from the floor sanding machine of FIG. 2.

Referring to the drawings, FIG. 1 illustrates a floor sanding machine 10 embodying the present invention which generally includes a motor assembly 11, a handle assembly 12 as would be understood in the art, and a sander housing 13. FIG. 2 illustrates a view of the underside of the sander housing 13, where a planetary disk 14 and plurality of sanding head units 15 are visible. The planetary disk 14 and the sanding head units 15 generally comprise a sanding adaptor 16. FIG. 3 illustrates the sanding adaptor 16 as removed from the floor sanding machine 10, for ease of reference. As can be seen, sanding adaptor 16 may further include a mounting plate 17 designed to engage with a drive shaft from the motor in motor assembly 11, as would be understood in the art. However, an isolator 18, which may be composed of a rubber or other damping material, may also be present between or about the mounting plate 17 and planetary disk 14.

As seen in FIGS. 2 and 3, the sanding adaptor 16 may include six sanding head units 15, spaced therearound. Each sanding head unit 15 is preferably rotatably connected to the planetary disk 14. Even as the planetary disk 14 rotates about its central axis, each sanding head unit 15 can freely rotate about its own rotational axis, creating a plantary or orbital rotation pattern. Further, in an example embodiment, each sanding head unit 15 is oriented at an angular incline. For example, the outermost edge 19 of each sanding head unit 15 may be lower (i.e., toward the ground) with respect to the innermost edge 20 of each sanding head unit 15. The differing orientations of the sanding head units 15 cause each one to spin independently of one another. As the entire sanding adaptor 16 rotates about its axis, the individual sanding head units 15 counter-rotate from friction with the floor. This action provides small and random scratch patterns in the wood substrate, which helps to hide any cross-grain scratching at a relatively low cost of production (compared to belt or gear driven styles of sanding heads). At the same time, isolator 18 softens vibrations and/or side gouging that might occur from a user's fast actuations, which might otherwise damage the flooring surface appearance.

Referring back to FIG. 1, motor assembly 11 includes a motor mounted within a housing 21. In an example embodiment, the motor is a two (or more) speed DC rectified electric motor. For example, the motor may be selectively operable at 175 and 300 revolutions per minute, with a selector switch operable to select between the two. As would be understood, other selector mechanisms could be used for motors having more than two speeds. Multiple speeds are employed because simply having a single high speed (e.g., 300 RPM) motor could seriously limit the sanding machine's utility. The greatest production—but also the greatest heat—is realized at this higher RPM. With a fine grit sanding abrasive, it would be possible to burn or burnish the wood floors, thereby close the wood's pours. This would make application of a colorant stain difficult and uneven. To combat these issues, the lower speed setting can be selected in the final finish stages of sanding. Combined with the above-discussed planetary motion, a multi-speed motor with user-selectable speed settings yields better results when using fine grit abrasives.

Figure 4:
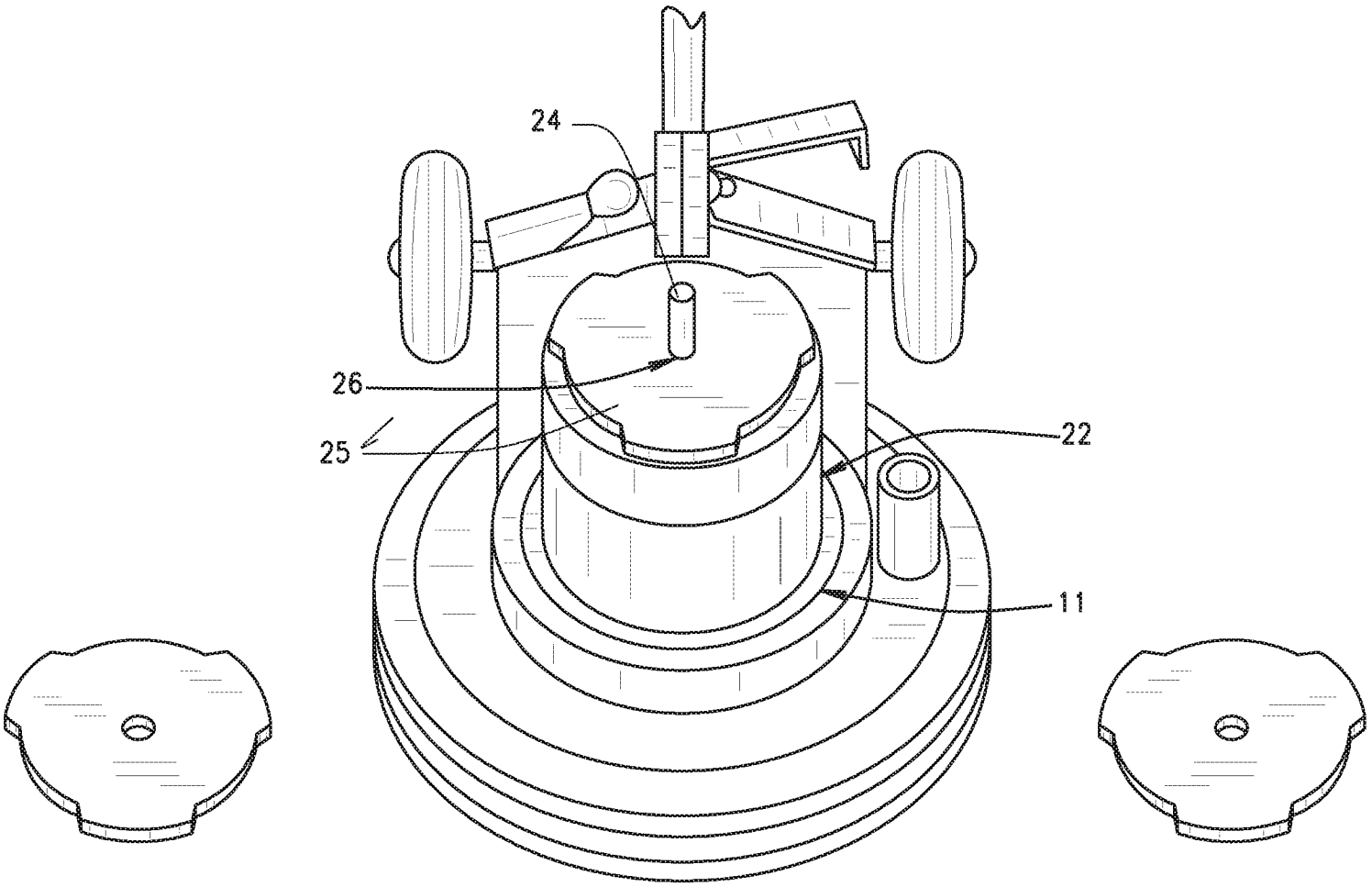
FIG. 4. is a top perspective view of a weight holder on top of a motor assembly on the floor sanding machine of FIG. 1.

In another example embodiment, as shown in FIG. 1, the motor assembly 11 may include a weight holder 22 on its top. The weight holder 22 preferably includes a base plate 23 and a mounting shaft 24. FIG. 4 illustrates a view of the motor assembly 11 and weight holder 22 with a weight 25 installed thereon. As can be seen, the weight 25 may include a through-hole 26 through which the mounting shaft 24 of the weight holder 22 may extend. The weight 25 is therefore held in place on top of the base plate 23 by the mounting shaft 24 extending through the through-hole 26. One or more than one weight 25 could be utilized. For example, each weight 25 may be approximately fifteen pounds, and up to three weights 25 may be used. This allows the user to adjust the PSI loading on the sanding head units 15 for more aggressive cutting or finer finishing.

When combined, the planetary motion of the sanding head units 15, the multi-speed motor with user-selectable speed settings, and an adjustable PSI, bring higher quality finishing options while maintaining higher productivity than existing orbital/planetary sanders. It will be understood that the structure hereof is specifically discussed in terms of sanding equipment, but could be equally relevant to concrete grinders, concrete polishers, stripping machines, etc. For the purposes hereof, the terms "sanding" and "sander" shall be understood broadly enough to encompass these other concepts as well.

From the foregoing, it will be seen that the various embodiments of the present invention are well adapted to attain all the objectives and advantages hereinabove set forth together with still other advantages which are obvious and which are inherent to the present structures. It will be understood that certain features and sub-combinations of the present embodiments are of utility and may be employed without reference to other features and sub-combinations. Since many possible embodiments of the present invention may be made without departing from the spirit and scope of the present invention, it is also to be understood that all disclosures herein set forth or illustrated in the accompanying drawings are to be interpreted as illustrative only and not limiting. The various constructions described above and illustrated in the drawings are presented by way of example only and are not intended to limit the concepts, principles and scope of the present invention.

As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required."

Many changes, modifications, variations and other uses and applications of the present constructions will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A floor sander comprising:

a motor having at least two selectable speeds;

a sanding adaptor driven to rotate about a rotational axis by the motor, the sanding adaptor including:

a planetary disk that rotates about the rotational axis of the sanding adaptor; and a plurality of sanding head units, each coupled to the planetary disk for independent rotational movement thereof, such that each sanding head unit rotates about its own rotational axis independently of any other sanding head unit or the planetary disk;

a weight holder positioned generally above the sanding adaptor; and an isolator positioned generally between the planetary disk and the motor.

2. The floor sander of claim 1 wherein the motor is a two speed DC rectified motor.

3. The floor sander of claim 1 further comprising a switch for selecting between the at least two selectable speeds of the motor.

4. The floor sander of claim 1 wherein the weight holder is positioned above the motor.

5. The floor sander of claim 1 wherein the weight holder includes a base plate and a mounting shaft.

6. The floor sander of claim 1 wherein the weight holder is oriented and positioned to hold a selectable number of weights thereon, wherein each added weight adds to pressure exerted by the plurality of sanding head units.

7. The floor sander of claim 1 wherein:

each of the sanding head units has an outer edge generally facing radially outwardly from the floor sander, each of the sanding head units has an inner edge generally facing radially inward toward the rotational axis of the planetary disk, and the inner edge of each of the sanding head units is positioned above the outer edge of each of the sanding head units with respect to a floor surface, such that each sanding head unit has a rotational axis that is not perpendicular to the floor surface.

8. The floor sander of claim 1 wherein a first speed of the motor is about 175 RPM, and a second speed of the motor is about 300 RPM.

* * * * *